US007404239B1

(12) United States Patent
Walton et al.

(10) Patent No.: US 7,404,239 B1
(45) Date of Patent: Jul. 29, 2008

(54) ADJUSTER FOR ADJUSTABLE RESTRAINT STRAP

(76) Inventors: Michael James Walton, 4329 E. Monte Way, Phoenix, AZ (US) 85044; Agus Suryana The, 9117 E. Hillview Cir., Mesa, AZ (US) 85207; Erin Edward Holmberg, 707 W. Los Lagos Vista Ave., Mesa, AZ (US) 85210; Timothy Andrew Swann, 5811 E. Fairfield St., Mesa, AZ (US) 85205

( * ) Notice: Subject to any disclaimer, the term of this patent is extended or adjusted under 35 U.S.C. 154(b) by 410 days.

(21) Appl. No.: 10/832,193

(22) Filed: Apr. 26, 2004

(51) Int. Cl.
*A44B 11/12* (2006.01)

(52) U.S. Cl. ..... 24/193; 24/170; 24/197; 24/68 CD; 24/71 ST; 24/71 TD

(58) Field of Classification Search ..... 24/69 R, 24/69 ST, 69 CT, 69 SB, 69 WT, 71 SB, 715 T, 24/71 TD, 685 B, 68 CD, 191, 193, 197, 24/170
See application file for complete search history.

(56) References Cited

U.S. PATENT DOCUMENTS 1,438,898 A * 12/1922 Carpmill ..... 24/191
4,184,234 A 1/1980 Anthony et al.
4,660,889 A 4/1987 Anthony et al.
4,726,625 A 2/1988 Bougher
4,843,688 A * 7/1989 Ikeda ..... 24/170
4,876,770 A 10/1989 Bougher
5,031,962 A 7/1991 Lee
5,039,169 A 8/1991 Bougher et al.
5,160,186 A 11/1992 Lee
5,286,090 A 2/1994 Templin et al.
5,311,653 A 5/1994 Merrick
5,920,963 A * 7/1999 Chou ..... 24/170
7,010,836 B2 * 3/2006 Acton et al. ..... 24/265 BC

* cited by examiner

*Primary Examiner*—Jack W. Lavinder
(74) *Attorney, Agent, or Firm*—Perkins Coie LLP

(57) ABSTRACT

An adjuster is provided for a restraint system having a belt which extends through the adjuster and includes a free end and another end or fastening end which is adapted to be secured to an object. The adjuster allows adjustment of the length of the belt between the adjuster and the fastening end. The adjuster includes a frame having a base member with an opening. The opening defines a first or edge plate and a second or securement plate. The first plate and the opening define a belt engaging edge. A clamping member is pivotally mounted between upright side flanges, the clamping member includes a pivoting lever and a load bar having a clamping edge, and a resilient spring member which urges the clamping member to rotate the clamping edge toward the belt engaging edge of the frame.

14 Claims, 5 Drawing Sheets

ADJUSTER FOR ADJUSTABLE RESTRAINT STRAP

FIELD OF THE INVENTION

The invention relates, generally, to a restraint system having a strap and an adjuster and, more particularly, to a belt adjuster for such a restraint, system for use in a vehicle having a lower anchor and upper tether system.

BACKGROUND OF THE INVENTION

Restraint systems are used in various applications including child restraint systems for a vehicle, restraint systems for cargo loaded upon a pallet, etc.

The prior art includes various types of child safety seats, including rear-facing infant seats which may or may not include a removable base, convertible seats which may be rear or forward-facing, forward-facing only seats, high-back booster seats with a five-point harness, and belt positioning booster seats, for example. Initially, the various child restraint systems were designed to be used with the seatbelts of a vehicle, which seatbelts were originally developed for adult passengers. The prior art seatbelts include lap belts and three-point belts. With the many types of child restraint seats and the various manufacturers, one of the problems with installing child restraint seats properly has always been the incompatibility between the child restraint seat and the vehicle belt system.

To address the incompatibility and to arrive at a standard, various countries are implementing legislation to provide guidelines as to a system to be installed in vehicles for the securing of child restraint seats.

The lower anchor and tethers for children (LATCH) system was designed to make installation of child safety seats easier by requiring child safety seats to be installed without using the vehicles seat belt system. The system requires all new forward-facing child safety seats (not including booster seats) to meet stricter head protection requirements, which calls for a top tether strap. The top tether strap is adjustable via an adjuster and is attached to the back of a child safety seat. The strap includes a hook for securing the child safety seat to a tether anchor found on the rear shelf area of the vehicle or, in the case of mini-vans and station wagons, on the rear floor or on the back of the rear seat of the vehicle. In addition to the tether anchor, the system requires two rear seating positions of all cars, mini-vans and light trucks to become equipped with lower child safety seat anchorage points located at the seat bight, i.e., between the vehicle's seat cushion and the vehicle's seat back. Further, the system requires that all child safety seats will have two attachments which will connect to the vehicle's lower anchorage attachment points. Together, the lower anchors and upper tethers make up the LATCH system.

In accordance with the LATCH system, a child restraint seat is secured to the lower anchor of a vehicle with two clips or hooks. The hooks are coupled to the child restraint seat via a belt or webbing which either extends from each hook to a secured point on the child restraint seat, or via webbing which extends through the structure of the child restraint seat. The belt is adjustable by means of a belt adjuster.

The prior art suffers several disadvantages. For example, current adjuster devices for lower anchor and upper tether assemblies rely on the webbing or belt tension to lock. The greater the tension or load on the belt, the more difficult for the user to release the tension in the belt system. In addition, a prior art cam adjuster with a serrated edge cuts the belt when high loads are imposed in the belt.

SUMMARY OF THE INVENTION

It is an object of the present invention to provide a strap restraint system having an adjuster, wherein the strap may be easily adjusted even when the strap is under tension.

It is a further object of the present invention to provide a belt restraint system having an adjuster wherein high loads do not cause the belt to be cut.

It is a still a further object of the present invention to provide an adjuster for a restraint system, wherein the adjuster is easy and inexpensive to manufacture.

The present invention provides an adjuster for a restraint system, the restraint system having a belt which extends through the adjuster. The belt includes a free end and another end or fastening end which is adapted to be secured to an object. The adjuster allows adjustment of the length of the belt between the adjuster and the fastening end, the adjuster comprising, a frame having a base member and upright side flanges, the base member includes an upper side, a lower side, and an opening, the opening defines a first or edge plate and a second or securement plate, the first and second plates extending between the upright side flanges, the first plate and the opening define a belt engaging edge, a clamping member pivotally mounted between the upright side flanges, the clamping member includes a pivoting lever and a load bar having a clamping edge; and a resilient spring member which urges the clamping member to rotate the clamping edge toward the belt engaging edge of the frame, whereby a belt may extend around the load bar, with the free end extending between the belt engaging edge and the clamping edge and through the base member opening and along the lower side of the first edge plate and away from the opening, and the fastening end of the belt extending through the opening and parallel and adjacent to the free end wherein tension introduced in the fastening end imposes a corresponding rotational force about the load bar which translates into a clamping force upon the free end between the clamping edge and the belt engaging edge, wherein a user may pull on the free end and decrease the length of the belt extending between the adjuster and the fastening end, and wherein a user may press the pivoting lever to rotate the clamping edge away from the belt engaging edge so as to free the belt to allow the belt length to be increased between the adjuster and the fastening end.

DETAILED DESCRIPTION OF THE INVENTION

Figure 1:
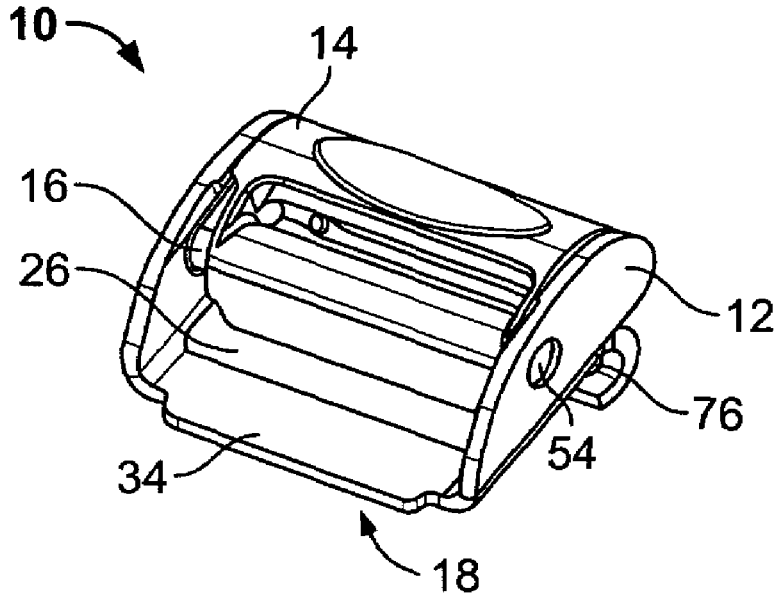
FIG. 1 is a perspective view of an adjuster in accordance with a preferred embodiment of the present invention.
Figure 2:
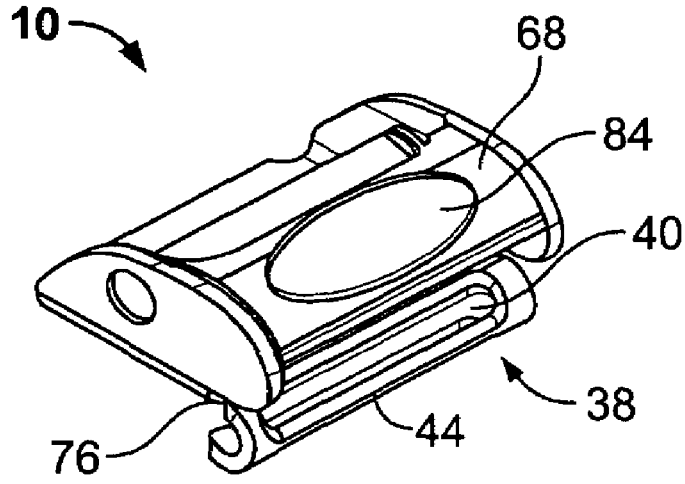
FIG. 2 is another perspective view of the adjuster of FIG. 1, from another view.
Figure 3:
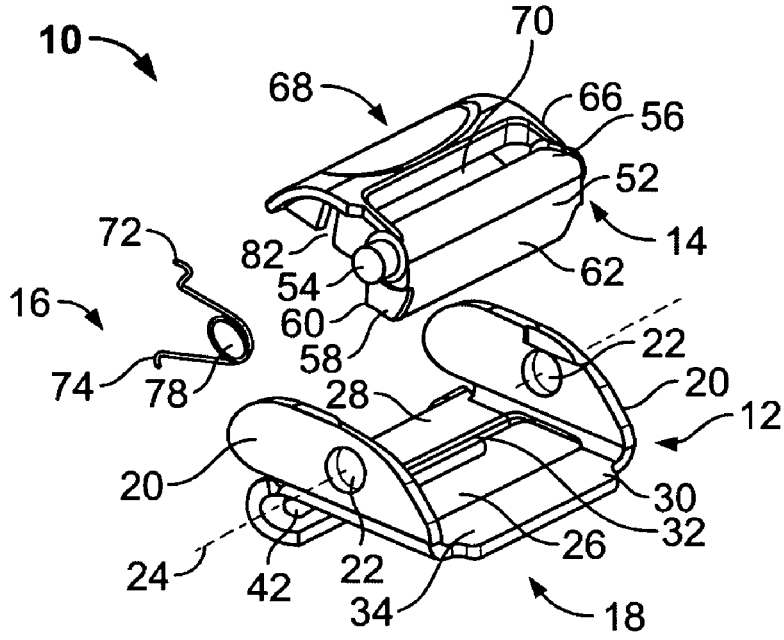
FIG. 3 is an exploded view of the adjuster of FIG. 1 in accordance with the present invention.

FIG. 1 is a perspective view of an adjuster 10 in accordance with a preferred embodiment of the present invention. The adjuster includes a frame 12, clamping member 14 and a resilient member or spring 16. FIG. 2 is another perspective view of the adjuster 10 of FIG. 1. FIG. 3 is an exploded view of the adjuster 10 of FIG. 1.

Figure 4:
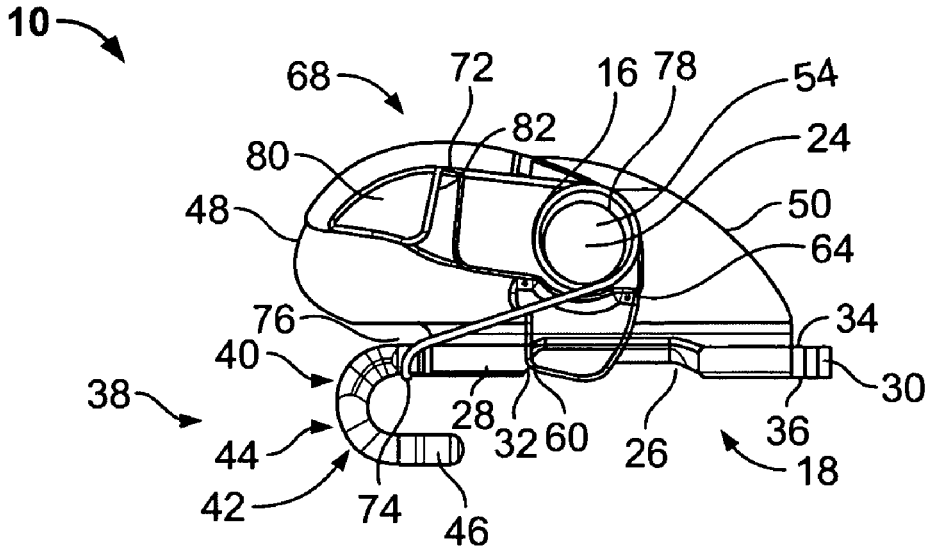
FIG. 4 is a cross sectional side view of the adjuster of FIG. 1 in accordance with the present invention.

FIG. 4 is a cross-sectional side view of the adjuster 10 of FIG. 1. With reference to FIGS. 1-4, it can be seen that the frame 12 of the adjuster 10 may be fabricated from a single sheet of metal. The frame 12 includes a base member 18 and two upright side flanges 20 which are spaced apart and parallel from one another. The side flanges 20 include opposed-facing openings 22. A longitudinal axis 24 extends through the opposed-facing openings. The base member 18 has a punched out opening 26 which forms a first or edge plate 28 and a second or securement plate 30. The first and second plates 28, 30 extend in the same plane. The first or edge plate 28 presents a belt-engaging edge 32 at the base member opening 26. It can be seen from FIG. 4 that the belt-engaging edge 32 is displaced below and to the left of the longitudinal axis 24. It can be further seen that the base member 18 includes an upper side 34 and a lower side 36. A portion of the base member 18 extending to the left as seen if FIG. 4, forms a belt guide 38. The belt guide 38 includes a portion of the base member having a first slot 40 and second slot 42 with a belt flange 44 formed therebetween. The base member 18 has been bent at the belt guide 38 so as to extend in a direction 180° from the original position. An end portion 46 of the belt guide 38 extends in a plane parallel and below the plane of the first and second plates 28, 30. The upright side flanges include a profile having a substantially round rear portion 48 and a downwardly-sloping front portion 50.

The clamping member 14 is shown to be a single piece cast component. The clamping member 14 includes a load bar 52 having pins 54 extending from a proximal end 56 of the load bar 52 and which extend along the longitudinal axis 24 of the upright side flange openings 22. A distal end 58 of the load bar 52 includes a clamping edge 60. A front surface 62 of the load bar 52 includes a belt-receiving load surface 64. The belt receiving load surface 64 is provided with a rough surface. Extending from the proximal end 56 of the load bar 52 via two side flanges 66 is a pivot release lever 68. FIGS. 1 and 3 show a belt slot 70 formed within the clamping member 14. FIG. 4 shows that the pivoting release lever 68 extends from the longitudinal axis 24 and over and beyond the belt-engaging edge 32. FIG. 4 also shows that the clamping edge 60 of the clamping member 14 is aligned and engaged with the belt engaging edge 32 of the base member 18. The resilient member or spring 16 as shown in FIG. 3 includes one end having two bends to form an L-shaped end 72, and a second end which includes a bend to form an outwardly curved end 74. The base member 18 includes two notches 76 formed in the first or edge plate 28. The spring 16 forms a spring opening 78 which is received by one of the load bar pins 54 between the clamping member 14 and one of the upright side flanges 20. The clamping member 14 further includes a wall 80 having a spring receiving slot 82. FIG. 4 shows the spring opening 78 received by the pin 54 with the L-shaped end 72 of the spring 16 received within the slot 82 and the outwardly curved end 74 received by one of the base member notches 76. The spring 16 urges the clamping member 14 to rotate in a clockwise direction as view from FIG. 4, urging the clamping edge 60 into engagement with the belt-engaging edge 32. It will be appreciated that a downwardly exerted force upon the pivoting release lever 68 as viewed in FIG. 4, will provide a counter force to the spring force and urge the clamping edge 60 out of engagement and away from the belt-engaging edge 32. FIG. 2 shows the recessed and textured surface 84 provided in the pivoting release lever 68.

Figure 5:
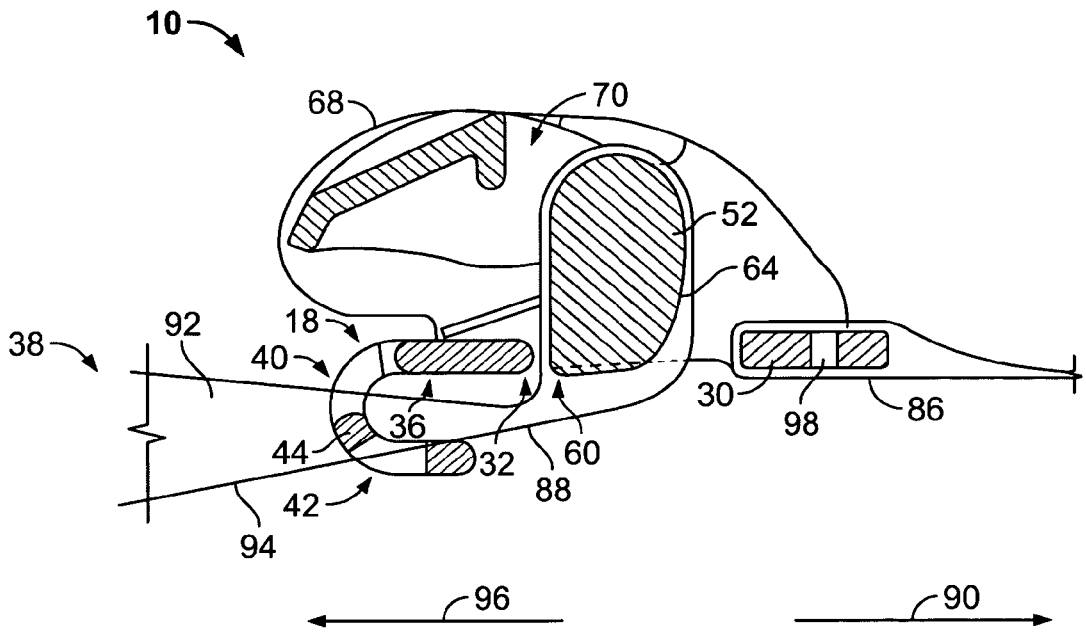
FIG. 5 is a cross sectional side view of an adjuster similar to the adjuster of FIG. 1 showing the path of a belt through the adjuster, in accordance with the present invention.

FIG. 5 shows a cross-sectional side view of an adjuster 10 similar to FIGS. 1-4, but wherein belts 86, 88 have been included as anticipated in the preferred embodiment of the adjuster 10 of FIGS. 1-4. To the right in FIG. 5, a nonadjustable belt 86 is shown. One end of the belt 86 has been looped around the securement plate 30 and extends in an attachment belt direction shown by arrow 90. The one end of belt 86 may be sewn so as to be secured about the adjuster 10. The other end (not shown) of the belt 86 may be secured to a fastener or a stationary object, for example. The adjustable belt 88 shown in FIG. 5 extends around the load bar 52 and through the belt slot 70. A free end 92 of the belt 88 extends past the belt-engaging edge 32 and clamping edge 60 and beneath the lower side 36 of the base member 18 and through the first slot 40 of the belt guide 38. The second or fastening end 94 of the belt 88 extends below the first or free end 92 of the belt 88 and through the second slot 42 of the belt guideway 38. The second or fastening end 94 extends in an adjustable belt direction as shown by arrow 96. The second or fastening end 94 is coupled to a fastener or stationary object (not shown), for example.

It will be appreciated that the restraint system is tightened by means of pulling on the free end 92 of the belt 88. In this manner, the slack is taken out of the fastening end 94 of the belt 88. As soon as tension is introduced in the belt 88, the fastening end 94 engages the load surface 64 of the load bar 52 and causes the load bar 52 to rotate in a clockwise direction as viewed in FIG. 5. With the load bar 52 turning clockwise in FIG. 5, the clamping edge 60 pinches the belt 88 extending between the clamping edge 60 and the belt engaging edge 32, and thereby prevents movement of the belt 88 which would introduce slack into the fastening end 94.

Slack may be introduced into the restraint system by means of exerting pressure upon the pivoting release lever 68 causing it to rotate in a counterclockwise direction as viewed in FIG. 5. Such movement will cause the clamping edge 60 to release the pressure upon the belt 88 extending between the clamping edge 60 and the belt engaging edge 32. The fastening end 94 may then be grasped and pulled in the adjustable belt direction 96 so as to introduce slack into the restraint system.

The fulcrum provided by the pivoting release lever 68 assists the user in introducing slack into the restraint system even when a substantial amount of tension exists in the restraint system. In an alternative embodiment, the securement plate 30 of FIG. 5 may include an optional opening 98 to receive a fastener (not shown) for fastening the belt 86 to the securement plate 30.

Figure 6:
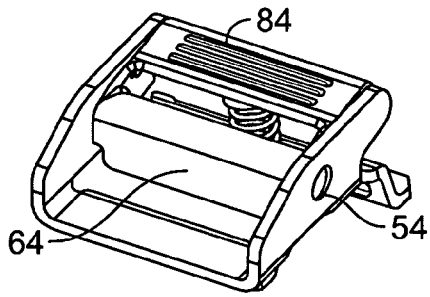
FIG. 6 is a perspective view of an adjuster in accordance with another embodiment of the present invention.
Figure 7:
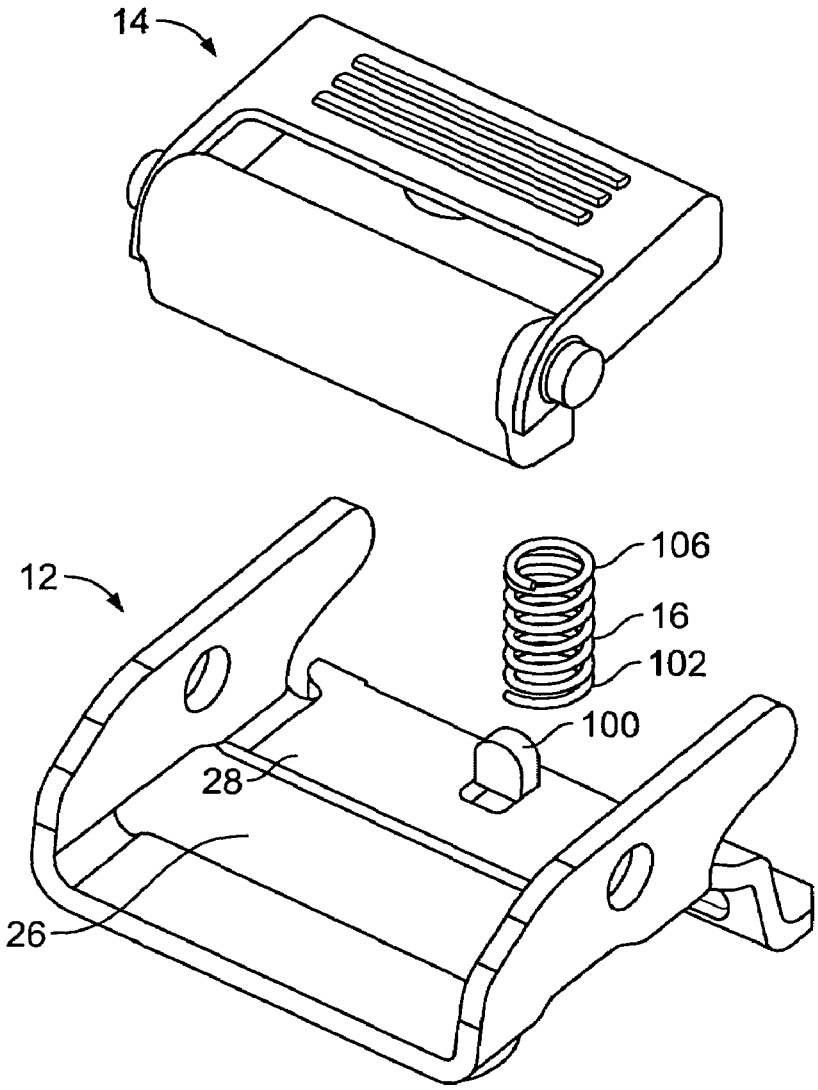
FIG. 7 is an exploded view of the adjuster of FIG. 6.
Figure 8:
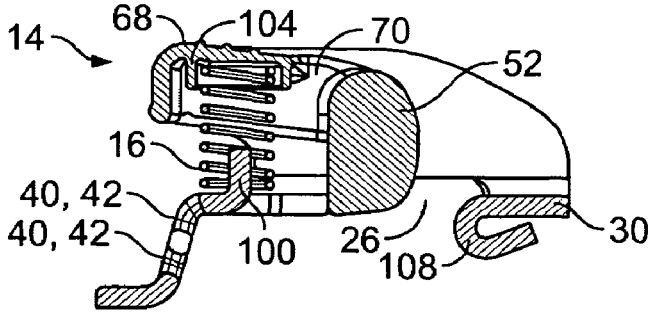
FIG. 8 is a cross sectional side view of the adjuster of FIG. 6.

FIG. 6 is a perspective view of an alternate embodiment of the adjuster 10 in accordance with the present invention. FIG. 7 is an exploded view of the adjuster 10 of FIG. 6. FIG. 8 is a cross-sectional side view of the adjuster 10 of FIG. 6.

It can be seen that the resilient member 16 takes the form of a helical spring. The edge plate 28 includes an upwardly bent tab 100 to receive one end 102 of the helical spring 16. The clamping member 14 includes a spring retainer 104 in the pivoting release lever 68 to receive the other end 106 of the helical spring 16. The opening 26 of the base member 18 is formed by punching out a center portion 108 of the base member 18 and bending it downwardly so as to be substantially parallel to the second or securement plate 30.

Figure 9:
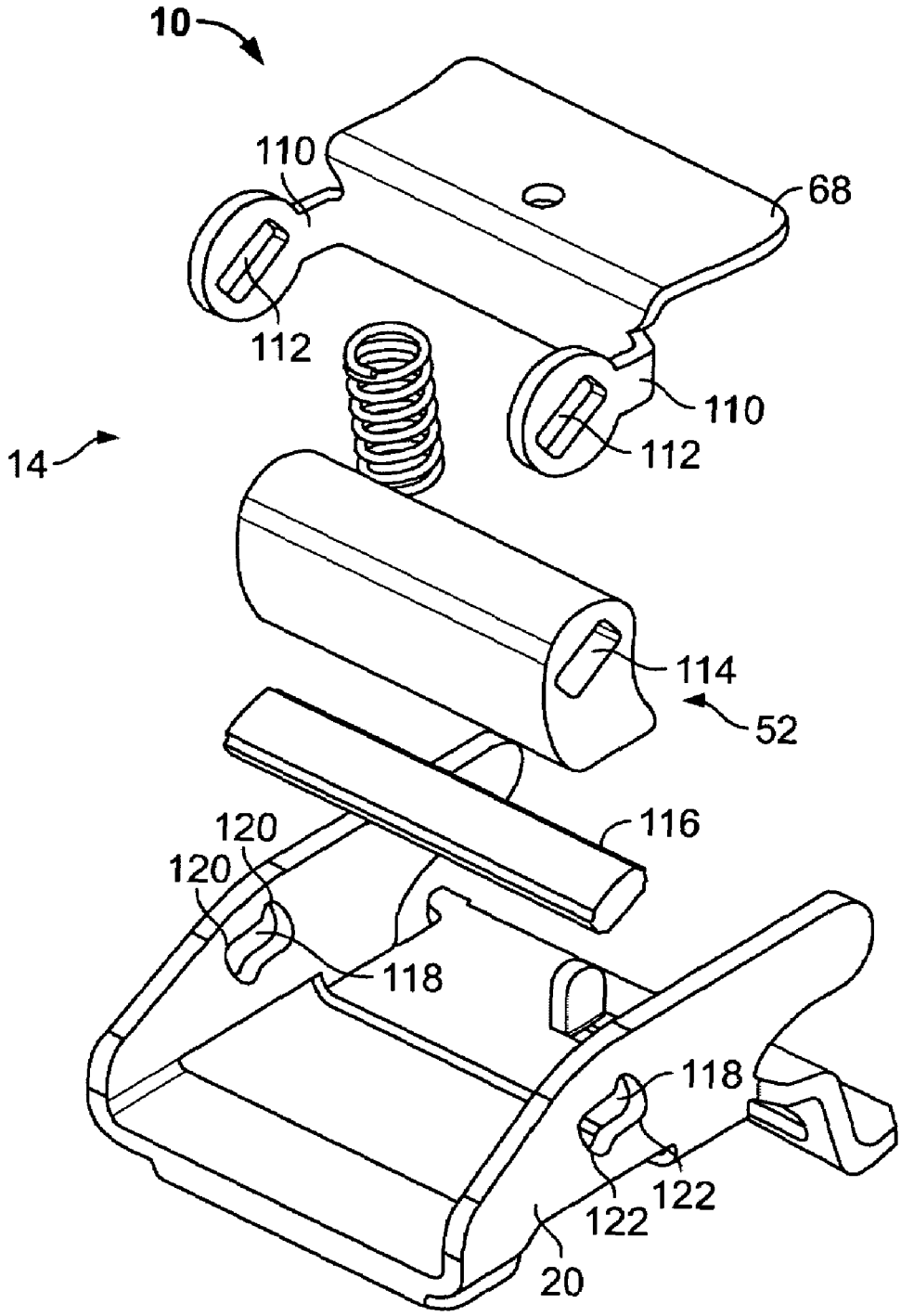
FIG. 9 is an exploded view of an adjuster in accordance with a further embodiment of the present invention.

FIG. 9 is an exploded view of an adjuster 10 in accordance with a further alternate embodiment of the present invention.

The clamping member 14 is composed of three discrete components. In particular, a clamping member 14 includes a pivoting release lever 68 having a pair of pivot flanges 110 with slot-shaped openings 112. The load bar 52 includes a longitudinally extending bore 114 which has a rectangular cross-section. The pin 54 is a flat bar 116 having a cross-section which is a similar shape as the longitudinally extending bore 114 and the openings 112 in the pivot release lever 68. The upright side flanges 20 include slots 118 having upper stops 120 and lower stops 122. The flat bar 116 is received in the slots 118 of the upright side flanges 20 and can rotate within the slot roughly 20° as established by the boundary of engaging the stops 120, 122. It will be apparent that the longitudinally extending bore 114 of the load bar 52 and the openings 112 of the pivot release lever 68 are aligned with the slots 118 of the upright side flanges 20 whereupon the flat bar 116 is inserted through the upright side flanges 20. The flat bar 116 is secured in place by means of deforming the ends of the flat bar 116 so as to prevent the flat bar 116 from sliding out of the frame 12. Other embodiments are contemplated, including a clamping member made of two separate discrete components, as an example. In addition, it is contemplated that the resilient member 16 could be integrated into the clamping member 14.

What is claimed is:

1. A restraint system, comprising:

a belt having a first or free end and a second or fastening end;

an adjuster having a frame with a base member and upright side flanges, the base member includes an upper side, a lower side, and an opening, the opening defines a first or edge plate and a second or securement plate, the first and second plates extending between the upright side flanges, the first plate and the opening define a belt engaging edge; a clamping member pivotally mounted between the upright side flanges, the clamping member includes a pivoting release lever and a load bar having a clamping edge; and a resilient spring member which urges the clamping member to rotate the clamping edge toward the belt engaging edge of the frame;

wherein the upright side flanges include opposed facing openings, the pivotal release lever includes a pair of pivot flanges having openings aligned with the upright side flange openings, and the load bar includes pins extending outwardly along a longitudinal axis, the pins are received by the upright side flange openings, respectively, for rotational movement about the longitudinal axis;

wherein the load bar includes a longitudinally extending bore which receives a pin, the pin having ends which extend out of the load bar and are received by the upright flange openings; and wherein the pin is a flat bar, and the openings of the upright flanges have the shape of a slot with stops, the slots allowing rotational movement of the bar between the stops.

2. The restraint system of claim 1, wherein the upright side flanges include opposed facing openings, and the clamping member includes pins extending outwardly along a longitudinal axis, the pins are received by the upright side flange openings, respectively, for rotational movement about the longitudinal axis.

3. The restraint system of claim 1, wherein the clamping member is made of a single piece component.

4. The restraint system of claim 1, wherein the frame includes a belt guide.

5. The restraint system of claim 1, wherein the pivoting release lever includes a recessed and textured surface.

6. A restraint system, comprising:

a belt having a first or free end and a second or fastening end; and an adjuster having a frame with a base member and upright side flanges, the base member includes an upper side, a lower side, and an opening, the opening defines a first or edge plate and a second or securement plate, the first and second plates extending between the upright side flanges, the first plate and the opening define a belt engaging edge; a clamping member pivotally mounted between the upright side flanges, the clamping member includes a pivoting release lever and a load bar having a clamping edge; and a resilient spring member which urges the clamping member to rotate the clamping edge toward the belt engaging edge of the frame;

wherein the base member of the frame includes a belt flange extending below the base member and having a first slot near a proximal end of the flange and a second slot at a distal end of the flange, the first or proximal slot receives the free end and the second or distal slot receives the fastening end.

7. The restraint system of claim 6, wherein the belt flange is curved.

8. An adjuster for a restraint system, the restraint system having a belt which extends through the adjuster and includes a free end and another end or fastening end which is adapted to be secured to an object, wherein the adjuster allows adjustment of the length of the belt between the adjuster and the fastening end, the adjuster comprising:

a frame having a base member and upright side flanges, the base member includes an upper side, lower side, and an opening, the opening defines a first or edge plate and a second or securement plate, the first and second plates extending between the upright side flanges, the first plate and the opening define a belt engaging edge;

a clamping member pivotally mounted between the upright side flanges, the clamping member includes a pivoting lever and a load bar having a clamping edge; and a resilient spring member which urges the clamping member to rotate the clamping edge toward the belt engaging edge of the frame, whereby a belt may extend around the load bar, with the free end extending between the belt engaging edge and the clamping edge and through the base member opening and along the lower side of the first edge plate and away from the opening, and the fastening end of the belt extending through the opening and parallel and adjacent to the free end wherein tension introduced in the fastening end imposes a corresponding rotational force about the load bar which translates into a clamping force upon the free end between the clamping edge and the belt engaging edge, wherein a user may pull on the free end and decrease the length of the belt extending between the adjuster and the fastening end, and wherein a user may press the pivoting lever to rotate the clamping edge away from the belt engaging edge so as to free the belt to allow the belt length to be increased between the adjuster and the fastening end;

wherein the load bar rotates about a longitudinal axis, the load bar having rotational coupling pins extending outwardly from the longitudinal axis, the clamping member includes a load portion depending away from the longitudinal axis and in a direction toward the base member.

9. The adjuster of claim 8, wherein the clamping member is made of a single piece cast component.

10. An adjuster for a restraint system, the restraint system having a belt which extends through the adjuster and includes a free end and another end or fastening end which is adapted to be secured to an object, wherein the adjuster allows adjustment of the length of the belt between the adjuster and the fastening end, the adjuster comprising:

a frame having one end which extends towards an adjustable belt length direction, and a second end which extends towards an attachment point direction, the frame having a base member which presents a belt engaging edge facing the attachment point direction, the base member having a lower side extending from the belt engaging edge and toward the adjustable belt length direction, the frame having a pivot attachment point having a longitudinal axis which is spaced apart and substantially parallel to the belt engaging edge, the frame having an attachment point;

a load bar pivotally coupled to the frame at the pivot attachment point, the load bar pivotal about the longitudinal axis of the pivot attachment point, the load bar having a clamping edge at a distal end of the load bar and a belt receiving load surface which faces away from the adjustable belt length direction; and resilient member which urges the load bar to rotate about the longitudinal axis and urge the clamping edge toward the belt engaging edge, whereby the adjuster forms a belt path extending around the load bar, with a free end of the belt extending between the belt engaging edge and the clamping edge and along the lower side of the frame toward the adjustable belt length direction, and the fastening end of the belt extends below the frame and extends parallel and below the free end toward the adjustable belt length direction;

wherein the frame includes a belt flange extending below the base member and having a first slot near a proximal end of the flange and a second slot at a distal end of the flange, the first or proximal slot receives the free end and the second or distal slot receives the fastening end.

11. The adjuster of claim 10, wherein the attachment point is a securement plate, whereby the securement plate is used to anchor the adjuster to a mounting location.

12. The adjuster of claim 10, wherein the load bar includes a rough surface for engagement with the belt.

13. An adjuster for a restraint system, the restraint system having a belt which extends through the adjuster and includes a free end and another end or fastening end which is adapted to be secured to an object, wherein the adjuster allows adjustment of the length of the belt between the adjuster and the fastening end, the adjuster comprising:

a frame having one end which extends towards an adjustable belt length direction, and a second end which extends towards an attachment point direction, the frame having a base member which presents a belt engaging edge facing the attachment point direction, the base member having a lower side extending from the belt engaging edge and toward the adjustable belt length direction, the frame having a pivot attachment point having a longitudinal axis which is spaced apart and substantially parallel to the belt engaging edge, the frame having an attachment point;

a load bar pivotally coupled to the frame at the pivot attachment point, the load bar pivotal about the longitudinal axis of the pivot attachment point, the load bar having a clamping edge at a distal end of the load bar and a belt receiving load surface which faces away from the adjustable belt length direction;

resilient member which urges the load bar to rotate about the longitudinal axis and urge the clamping edge toward the belt engaging edge, whereby the adjuster forms a belt path extending around the load bar, with a free end of the belt extending between the belt engaging edge and the clamping edge and along the lower side of the frame toward the adjustable belt length direction, and the fastening end of the belt extends below the frame and extends parallel and below the free end toward the adjustable belt length direction; and further comprising a coiled spring having spring ends, one of the spring ends having two bends to form an L-shaped end, the other end having an outwardly curved end, the adjuster having a pivoting lever extending from the load bar and the longitudinal axis and in a direction over the belt engaging edge, the pivoting lever having a side wall with a spring receiving slot, the coiled spring is received by one of the attachment points and is located between the wall and the frame, with the L-shaped end received in the slot and the curved end engaged with the frame.

14. An adjuster for a restraint system, the restraint system having a belt which extends through the adjuster and includes a free end and another end or fastening end which is adapted to be secured to an object, wherein the adjuster allows adjustment of the length of the belt between the adjuster and the fastening end, the adjuster comprising:

a frame having one end which extends towards an adjustable belt length direction, and a second end which extends towards an attachment point direction, the frame having a base member which presents a belt engaging edge facing the attachment point direction, the base member having a lower side extending from the belt engaging edge and toward the adjustable belt length direction, the frame having a pivot attachment point having a longitudinal axis which is spaced apart and substantially parallel to the belt engaging edge, the frame having an attachment point;

a load bar pivotally coupled to the frame at the pivot attachment point, the load bar pivotal about the longitudinal axis of the pivot attachment point, the load bar having a clamping edge at a distal end of the load bar and a belt receiving load surface which faces away from the adjustable belt length direction;

resilient member which urges the load bar to rotate about the longitudinal axis and urge the clamping edge toward the belt engaging edge, whereby the adjuster forms a belt path extending around the load bar, with a free end of the belt extending between the belt engaging edge and the clamping edge and along the lower side of the frame toward the adjustable belt length direction, and the fastening end of the belt extends below the frame and extends parallel and below the free end toward the adjustable belt length direction; and further comprising a coiled helical spring, the adjuster having a pivoting lever extending from the load bar and the longitudinal axis and in a direction over the belt engaging edge, the pivoting lever having a first spring retainer facing downwardly, the base member having a second spring retainer facing upwardly and toward the first spring retainer, the coiled helical spring retained between the first and second spring retainers and urging the clamping edge toward the belt engaging edge.

* * * * *